United States Patent [19]

Saito et al.

[11] Patent Number: 4,772,146

[45] Date of Patent: Sep. 20, 1988

[54] RECORDING APPARATUS WITH A PLATEN DETACHABLY INCORPORATED THEREIN

[75] Inventors: Yasuhide Saito, Tokyo; Isao Tsukada, Kawasaki; Shigeki Mori, Tokyo; Hayato Shinohara, Yokohama; Kazumi Sekine, Kawasaki, all of Japan

[73] Assignee: Canon Kabushiki Kaisha, Tokyo, Japan

[21] Appl. No.: 906,079

[22] Filed: Sep. 10, 1986

[30] Foreign Application Priority Data

| | | | |
|---|---|---|---|
| Sep. 14, 1985 | [JP] | Japan | 60-140983[U] |
| Sep. 14, 1985 | [JP] | Japan | 60-140985[U] |
| Sep. 20, 1985 | [JP] | Japan | 60-144829[U] |
| Sep. 20, 1985 | [JP] | Japan | 60-144830[U] |
| Sep. 20, 1985 | [JP] | Japan | 60-144831[U] |
| Oct. 4, 1985 | [JP] | Japan | 60-220275 |
| Oct. 4, 1985 | [JP] | Japan | 60-220276 |
| Jan. 17, 1986 | [JP] | Japan | 61-004014[U] |

[51] Int. Cl.[4] ..... B41J 11/08

[52] U.S. Cl. ..... 400/649; 400/613.1; 400/656

[58] Field of Search ..... 400/649, 653, 613, 613.1, 400/656, 660

[56] References Cited

U.S. PATENT DOCUMENTS

| | | | |
|---|---|---|---|
| 3,905,462 | 9/1975 | Nowak | 400/660 X |
| 3,995,730 | 12/1976 | Kwan | 400/649 |
| 4,632,585 | 12/1986 | Oyamatsu | 400/613 |

FOREIGN PATENT DOCUMENTS

| | | | |
|---|---|---|---|
| 31361192 | 3/1983 | Fed. Rep. of Germany | 400/660 |
| 101883 | 8/1981 | Japan | 400/613 |
| 102789 | 6/1983 | Japan | 400/649 |
| 59-483 | 4/1984 | Japan | 400/613 |
| 59-35410 | 9/1984 | Japan | 400/649 |
| 198169 | 11/1984 | Japan | 400/613 |
| 22969 | 1/1986 | Japan | 400/613.1 |

*Primary Examiner*—Paul T. Sewell

*Attorney, Agent, or Firm*—Fitzpatrick, Cella, Harper & Scinto

[57] ABSTRACT

A recording apparatus preferably usable for desk-set type electronic calculator, computer, word processor, electronic typewriter or the like of the type having a platen detachably incorporated therein. The platen is operatively connected to an upper case. When it is to be removed from the apparatus, the case is first removed and the platen is then displaced away from the operative position by a turning movement in accordance with a removing movement of the case. Recording paper can be placed on the lower guide surface which is exposed to the outside. On completion of placing of the recording paper the case is closed together with the platen by way of the reverse steps until the platen assumes the operative position. To assure that the recording paper is stably held on the lower guide surface even after the platen is displaced away from the operative position, the base board is formed with an opposing pair of semi-spherical projections on the inner side walls. The platen may be raised up away from the operative position in the vertical direction instead of a turning movement. To inhibit the recording paper from becoming contaminated with ink, a contamination inhibitive plate is interposed between the platen and the printing belt or ring. It is preferable that the contamination inhibitive plate is raised up under the effect of resilient of coil springs at the same time when the platen is displaced away from the operative position.

5 Claims, 13 Drawing Sheets

RECORDING APPARATUS WITH A PLATEN DETACHABLY INCORPORATED THEREIN

BACKGROUND OF THE INVENTION

1. Field of the Invention

The present invention relates to a recording apparatus with a platen detachably incorporated therein which serves to hold recording medium, and more particularly to an improvement of a recording apparatus of the type including a main section having an outer case in which a recording section is accommodated and a holder disposed outwardly of the outer case to hold a roll-shaped recording paper thereon.

2. Related Background Art

Generally, a conventional recording apparatus of the above-mentioned type is so constructed that a platen is disposed at the position located opposite to a recording head and recording paper is introduced into the space as defined between the platen and the recording head before recording is effected. Introduction of recording paper in that way is carried out, for instance, by way of the steps of inserting recording paper into a paper insert slit which is located at the rear part of the apparatus and then turning on a feed switch. However, even though the leading end of the recording paper is forcibly inserted into the insert slit, it is often found that it fails to be correctly caught by a feed roller in the apparatus. This means that inserting of recording paper can be very troublesome work.

To obviate the foregoing problem there has been already made a proposal as to a recording apparatus of the above-mentioned type as shown in FIG. 1. (It should be noted that this prior invention was published in Japan under Japanese Utility Model Publication No. 35410/1984.) To facilitate understanding of the present invention it will be helpful that the prior invention will be described below with reference to FIG. 1. In the drawing reference numeral 1 designates a roll-shaped recording paper. The paper 1 is accommodated in the semicylindrical recess of a paper case 8. A part of the recording paper unwound from the paper roll is delivered to a printing head 6 via a guide 9. A paper cover 2 is disposed above the paper roll 1 in such a manner as to turn about a shaft 4. A part of the paper cover 2 includes a platen portion 2*a* at the position located opposite to the printing head 6. A tension roller 3 is adapted to come in pressure contact with a feed roller 5 rotatably disposed in the guide 9 is carried by the paper cover 2.

When recording paper is set in the space as defined between the platen portion 2*a* and the printing head 6, the paper cover 2 is first opened by turning movement in the direction as identified by reference character a, a roll-shaped recording paper 1 is placed in the paper case 8, a part of the recording paper unwound from the paper roll is then placed on the feed roller 5 and the printing head 6 and finally the paper cover 2 is closed by turning movement in the direction as identified by reference character b. However, it has been pointed out that the prior recording apparatus as proposed in the above-described manner still has the following drawbacks.

Since the paper cover 2 is designed to fully cover the roll-shaped paper 1, it is unavoidably molded in the widely extended plate-shaped configuration and therefore noise tends to be generated during the recording operation.

Next, since the platen is displaced relative to the printing head at the time when recording paper is loaded in the apparatus, there is a fear of performing the recording operation in spite of the fact that the platen fails to assume the correct operative position (where the platen is located correctly opposite to the printing head and the tension roller 3 is correctly brought in pressure contact with the feed roller 5). As a result, incorrect recording operation tends to be performed.

Another drawback of the conventional apparatus is that when the paper cover 2 is displaced away from the position as illustrated in FIG. 1 by a turning movement in the direction as identified by reference character a, the recording paper is liable to be stuck to the inner surface of the paper cover 2 under the influence of wind pressure, static electricity or the like, resulting in it being separated from the feed roller 5 and the guide 9. Thus, the roll-shaped paper is removed from the paper case 8 with many difficulties. When the recording paper is to be reset, there is often a need for peeling it away from the paper cover 2, correctly placing it on the feed roller 5 and the guide 9 again and then closing the paper cover 2 by a turning movement in the direction as identified by reference character b in the drawing. Thus, the resetting operation is troublesome work. (If the paper cover 2 is closed by turning movement in the direction as identified by reference character b while the recording paper is stuck to the paper cover 2, there is the fear of loosening or dislocating the recording paper from the correct position and in the extreme case it may be damaged.)

Another drawback of the conventional apparatus is that when the paper cover 2 is opened by a turning movement in the direction as identified by reference character a, recording paper is liable to recline on the printing head 6 (due to the fact that recording paper fails to be held by the guide 9 and the lower part of the platen portion 2*a*) and therefore there is a fear of causing recording paper to come in contact with the printing head in the contaminated state.

SUMMARY OF THE INVENTION

Hence, the present invention has been made with the foregoing background in mind and its object resides in providing a recording apparatus of the early-mentioned type which assures that feeding of recording medium is achieved more reliably and effectively.

Another object of the present invention is to provide a recording apparatus of the earlier-mentioned type which assures a remarkable reduction of the generation of vibrations and noise.

Another object of the present invention is to provide a recording apparatus which assures that the recording operation is performed only when the platen assumes the correct operative position.

Further, another object of the present invention is to provide a recording apparatus which assures that the recording medium is stably held with the aid of guide means when the platen is displaced away from the operative position.

Still further, another object of the present invention is to provide a recording apparatus which assures that the recording medium is inhibited from becoming contaminated with printing ink on the printing portion when the platen is displaced away from the operative position.

To accomplish the above objects there is proposed according to one aspect of the present invention a recording apparatus of the type including a main section having an outer case in which a recording section is accommodated and a holder disposed outwardly of the outer case to hold a roll-shaped recording paper thereon, essentially comprising guide means having the first guide surface along which a part of the recording paper unwound from the paper roll held on the holder is delivered to the recording position on the recording section where recording is effected, a paper feeding member disposed on the first guide surface of the guide means, platen means having the second guide surface adapted to be located opposite to the first guide surface, a thrust member adapted to come in forcible contact with the paper feeding member and a platen surface which is exposed to the recording position on the recording section, and holding means for detachably holding the platen means at the operative position where the second guide surface is located opposite to the first guide surface and the platen surface is exposed in the recording position on the recording section.

Further, there is proposed according to another aspect of the present invention a recording apparatus of the type including a main section having an outer case in which a recording section is accommodated and a holder disposed outwardly of the outer case to hold a roll-shaped recording paper thereon, essentially comprising holding means for holding recording medium, recording means by which recording is effected on the recording medium, platen means detachably held at the operative position where its platen surface is exposed to the recording position where recording is effected with the aid of the recording means, detecting means for detecting whether the platen means assumes the operative position or not, and controlling means for inhibiting initiating of at least one of the operations of the recording apparatus when the detecting means detects that the platen means assumes the inoperative position.

Further, there is proposed according to another aspect of the present invention a recording apparatus of the type including a main section having an outer case in which a recording section is accommodated and a holder disposed outwardly of the outer case to hold a roll-shaped recording medium thereon, essentially comprising holding means for holding a recording medium, recording means by which recording is effected on the recording medium, guide means having a guide surface along which the recording medium held by the holding means is delivered to the recording means, platen means detachably held at the operative position where its platen surface is exposed to the recording position where recording is effected by the recording means, and inhibiting means for inhibiting the recording medium from being separated from the guide surface when the platen means is displaced away from the operative position.

Furthermore, there is proposed according to yet another aspect of the present invention a recording apparatus of the type including a main section having an outer case in which a recording section is accommodated and a holder disposed outwardly of the outer case to hold a roll-shaped recording paper thereon, essentially comprising recording means by which recording is effected on the recording medium, guide means having a guide surface along which the recording medium is delivered to the recording position where recording is effected by the recording means, platen means detachably held at the operative position where its platen surface is exposed to the recording position where recording is effected by the recording means, and contamination inhibitive means disposed at the position between the recording means and the guide means and interposed between the recording medium and the recording means, the contamination inhibitive means being displaced toward the downstream side as seen in the direction of feeding of the recording medium when the platen is displaced away from the operative position.

Furthermore, there is proposed yet another aspect of the present invention a recording apparatus of the type including a main section having an outer case in which a recording section is accommodated and a holder disposed outwardly of the outer case to hold a roll-shaped recording paper thereon, essentially comprising recording means by which the recording is effected on recording medium with the aid of a printing member around which a series of printing types in the form of numerals, symbols or the like are arranged, guide means having a guide surface along which the recording medium is delivered to the recording position where recording is effected on the recording medium by the recording means, platen means detachably held at the operative position where its platen surface is exposed to the recording position where recording is effected by the recording means, and contamination inhibitive means interposed between the printing member and the recording medium, the contamination inhibitive means being made integral with cutter means for cutting the recording medium on which recording has been effected by the recording means.

Other objects, features and advantages of the present invention will become more clearly apparent from reading the following description which has been prepared in conjunction with the accompanying drawings.

BRIEF DESCRIPTION OF THE DRAWINGS

The accompanying drawings will be briefly described below.

FIG. 2 is a perspective view of the desk-set type electronic calculator.

FIG. 3 is a perspective view of the recording apparatus, particularly illustrating the inner detailed structure thereof in the exposed state.

FIG. 4 is a sectional view of the recording apparatus, illustrating the inner structure of the latter in the inoperative state where the platen is displaced away from the operative position by a turning movement thereof.

FIG. 5 is a sectional view of the recording apparatus similar to FIG. 4, particularly illustrating the inner structure thereof in the operative state where the platen assumes its operative position.

FIG. 6 is a block diagram illustrating the whole structure of the calculator in FIG. 2.

FIG. 7 is a flow diagram illustrating how controlling is effected for the calculator in FIG. 2.

FIG. 8 is a fragmental front view of a display portion on the calculator in FIG. 2, particularly illustrating an example of displaying the inoperative state where the platen does not assume the operative position.

FIG. 9 is a perspective view of the desk-set type electronic calculator.

FIG. 10 is a sectional view of the recording apparatus taken in line A—A in FIG. 9, particularly illustrating the inner structure thereof in the operative state where the platen assumes the operative state.

FIG. 11 is a sectional view of the recording apparatus taken in line A—A in FIG. 9, particularly illustrating the inner structure in the inoperative state where the platen does not assume the operative position.

FIG. 12 is a perspective view of the desk-set type electronic calculator.

FIG. 13 is a perspective view of the recording apparatus, particularly illustrating the inner detailed structure thereof in the exposed state.

FIG. 14 is a sectional view of the recording apparatus, particularly illustrating the inner structure of the latter in the inoperative state where the platen is displaced away from the operative position by a turning movement thereof.

FIG. 15 is a perspective view of the recording apparatus, particularly illustrating the operative state where the platen assumes the operative position.

FIG. 16 is a perspective view of the recording apparatus similar to FIG. 15, particularly illustrating the inoperative state where the platen is raised up away from the operative position in the vertical direction.

FIG. 17 is a perspective view of the calculator.

FIGS. 18 and 19 are a fragmental sectional view of the recording apparatus respectively.

FIG. 20 is a perspective view of the desk-set type electronic calculator in the partially exposed state, particularly illustrating the operative state where the platen assumes the operative position.

FIG. 21 is a perspective view of the calculator similar to FIG. 20, particularly illustrating the inoperative state where the platen is raised up away from the operative position in the vertical direction.

FIG. 22 is a fragmental sectional view of the recording apparatus corresponding to FIG. 20, illustrating the operative state where the platen assumes the operative position.

FIG. 23 is a fragmental sectional view of the recording apparatus corresponding to FIG. 21, illustrating the inoperative state where the platen is raised up away from the operative state in the vertical direction.

DESCRIPTION OF THE PREFERRED EMBODIMENTS

Now, the present invention will be described in a greater detail hereunder with reference to the accompanying drawings which illustrate preferred embodiments thereof. It should be noted that description will be made as to illustrated embodiments where a variety of printers usable for a desk-set type electronic calculator (hereinafter referred to as a calculator) exemplified as a recording apparatus but the present invention should not be limited only to them. Alternatively, they may be employed for various kinds of recording apparatus which are incorporated in a computer, a word processor, an electronic typewriter or the like.

Figure 1:
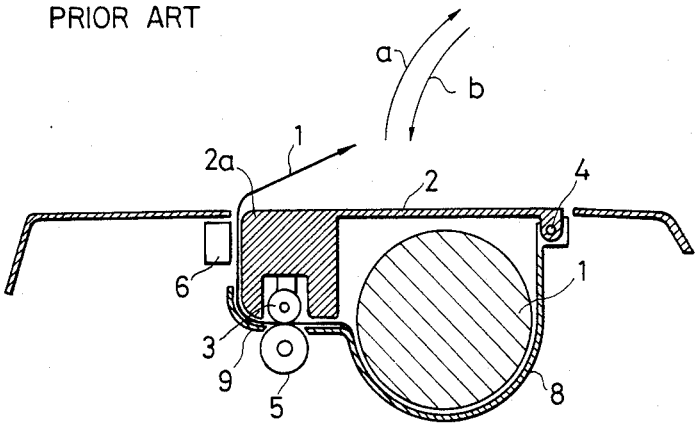
FIG. 1 PRIOR ART
FIG. 1 is a fragmental sectional side view of a conventional recording apparatus.
Figure 2:
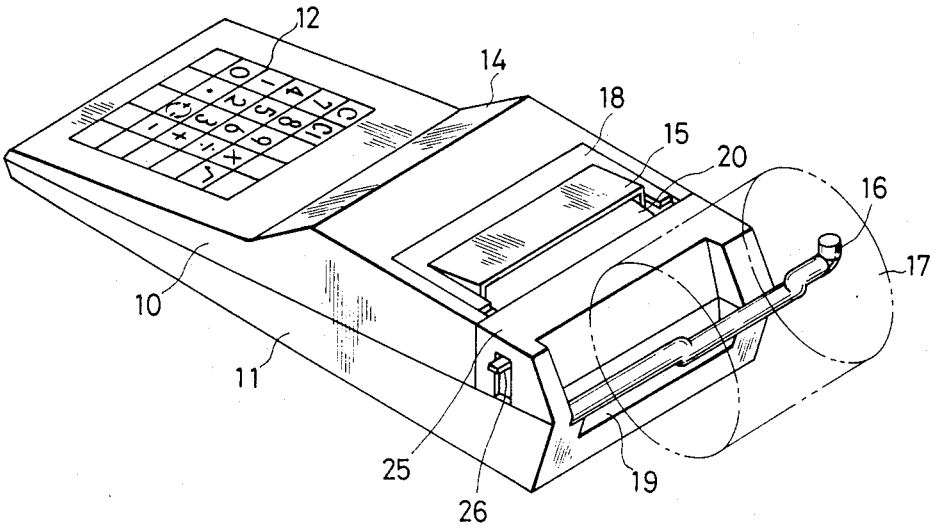
FIGS. 2 to 8 illustrates a desk-set type electronic calculator with a recording apparatus in accordance with the first embodiment incorporated therein.

FIG. 2 is a perspective view of a calculator in which a recording apparatus in accordance with the first embodiment of the invention is incorporated. In the drawing reference numeral 10 designates an upper case and reference numeral 11 does a lower case. A number of functional components constituting the calculator are accommodated in the hollow space as defined by a combination of the upper case 10 and the lower case 11. As is apparent from the drawing, a key board 12 is arranged on the fore side of the upper case 10 so that data input is carried out by operating the key board 12. Data output from the key board 12 is processed in a central processing unit (not shown) and the results obtained by processing are displayed on a display portion 14. Further, a paper cutter 15 molded of transparent plastic material such as acrylic resin or the like is disposed on the upper end part of the upper case 10. Specifically, the paper cutter 15 is fixedly secured to a printer cover 18 which is detachably fitted to the upper case 10 whereby a roll-shaped recording paper 17 held on a recording holder 16 is cut to a certain length by means of the paper cutter 15. The printing paper 17 held on the holder 16 is manually unwound by an operator and its leading end is inserted into an insert slit 19. After recording is achieved on the printing paper 17 by means of the recording apparatus, it leaves an outlet slit 20 and it is then cut with the aid of the paper cutter 15. Incidentally, the holder 16 is supported on the case.

The uppermost part 25 of the upper case 10 is turnably supported in such a manner as described later so that it is opened or locked by actuating a lock lever 26.

Figure 3:
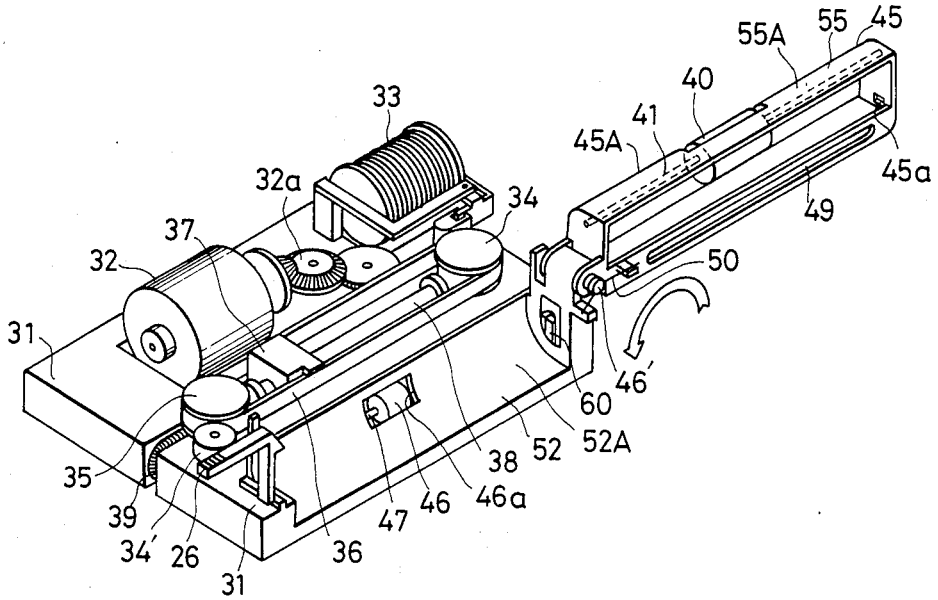
Figure 4:
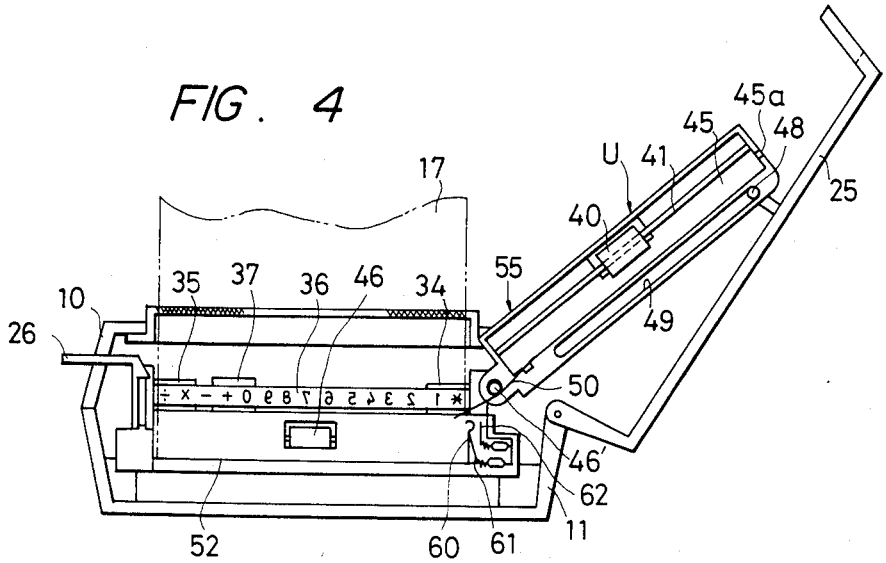

FIGS. 3 and 4 are intended to clearly show the detailed inner structure of the recording apparatus while the uppermost part 25 is kept opened. In FIG. 3 reference numeral 31 designates a base board for the printer and various components are mounted on the base board 31. A motor 32 is an electrically driven motor of which rotation is transmitted to a driving pulley 34 via a train of gears 32*a*. A printing belt 36 is endlessly extended between the driving pulley 34 and a driven pulley 35. As shown in FIG. 4, a series of printing types in the form of numerals, symbols or the like are molded integral with the printing belt 36 over the whole outer surface of the latter. A carriage shaft 38 is bridged between the driving pulley 34 and the driven pulley 35 so that a carriage 37 reciprocably slides along the carriage shaft 36. Forward movement of the carriage 37 is achieved in accordance with movement of one of the printing types and backward movement of the same is achieved under the effect of the resilient force of a return coil spring 39.

The carriage 37 has a hammer (not shown) incorporated therein and the hammer is actuated as a solenoid 33 is turned on.

Specifically, when the printing belt 36 is circulated with the aid of a combination of the driving pulley 34 and the driven pulley 35 as the motor 32 is rotated and thereby a required printing type to be subjected to printing assumes the position corresponding to the hammer incorporated in the carriage 37, the solenoid 33 is turned on, causing the printing belt 36 to stop its movement temporarily. Subsequently, the hammer is actuated and thereby the printing type is forcibly thrusted against the printing paper 17 under the effect of the hammering force generated by the hammer. As a result, printing is achieved on the printing paper 17 which is located between a platen 45 and the printing belt 36.

On completion of the first printing in that way, figure-up movement is carried out in such a manner that the carriage 37 is displaced by a distance of one figure in the direction toward upper figures (in the rightward direction as seen in FIG. 2) and at the same time the printing belt 36 is circulated by the same distance. After figure-up movement as mentioned above is repeated by the required number of figures, the carriage 37 is restored to its home position (the left end as seen in FIG. 3) under the effect of the resilient force of the coil spring 36. On completion of returning movement of the carriage 37, paper feeding is initiated. Incidentally, reference numeral 34' designates an ink roller which is normally brought in contact with the printing belt 36 to supply the latter with ink.

Paper feeding is achieved by rotating paper feeding means, for instance, a feed roller 46 while the printing paper 17 is clamped between paper retaining means, for instance, a pinch roller 40 and the aforesaid feed roller 46. The latter is rotatably supported on a shaft 47 which is extended on the base board 31 in the transverse direction, while the pinch roller 40 is rotatably supported on a flexible pinch roller shaft 41 which is accommodated in the platen 45. In the illustrated embodiment a platen unit U is constituted by a combination of the pinch roller 40, the pinch roller shaft 41, the platen 45 and an upper guide 55 which is molded integral with the platen 45. A guide surface 55A on the upper guide 55 is adapted to come in close contact with a guide surface 52A on the lower guide 52. As will be apparent from the above description, the platen unit U is such that it includes at least a platen and in addition it includes one or more in combination among the upper guide 55, the pinch roller 40 and the pinch roller shaft 41.

The platen 45 is supported to turn about a shaft 46' which is fixedly mounted on the base board 31 at the position located in the vicinity of one end of the printing paper 17 as seen in the direction of width thereof. The shaft 46' has a twist coil spring 50 mounted thereon of which one end is engaged to a part of the platen 45 and the other end is engaged to a part of the base board 31 whereby the platen 45 is normally urged to turn in the clockwise direction (as seen in FIG. 3). As shown in FIG. 4, the uppermost part 25 of the upper case 10 is provided with a pin 48 on the inner wall thereof and this pin 48 is slidably engaged to an elongated groove 49 which is formed on the platen 45. Further, the platen 45 is formed with an engagement hole **45*a* into which the foremost end of the lock lever 26 is inserted. Thus, when the uppermost part 25 of the upper case 10 is turned in the anticlockwise direction until the foremost end of the lock lever 26 is fitted into the hole 45*a*, both the uppermost part 25 and the platen 45 are brought in the locked state relative to the lower case 11 (see FIG. 5**).

It should be noted that the above-mentioned locked state represents the position where the platen 45 is located in the normal operative state. At this moment the platen surface 45A of the platen (see FIG. 3) assumes the recording position, that is, the position located opposite to the printing belt 36 and the guide surface 55A of the upper guide 55 comes in close contact with the guide surface 52A of the lower guide 52.

Figure 6:
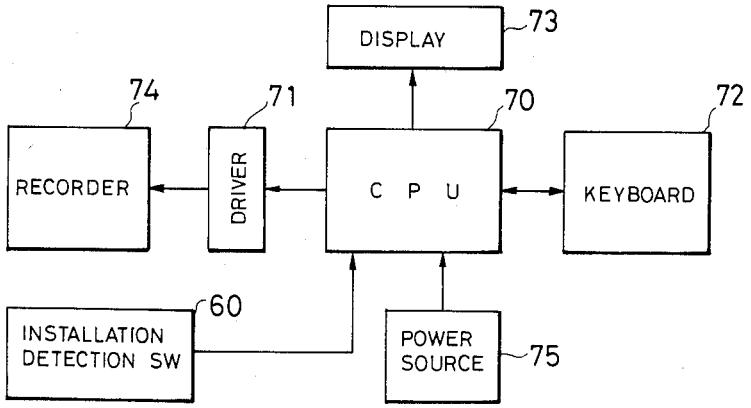

As shown in FIGS. 3 and 4, the apparatus is provided with a switch 60 comprising contact springs 61 and 62 on the side wall of the base board 31 in order to confirm whether or not the platen 45 is brought in the operative state. As will be best seen in FIG. 4, the contact spring 61 is projected inwardly of the side wall of the base board 31 by a short distance through a cutout which is formed on the side wall while the platen 45 is turned away from the operative position. Both the contact springs 61 and 62 are electrically connected to a central processing unit (hereinafter referred to as CPU) 70 via lead wires which are shown in FIG. 6). CPU 70 is so constructed that it processes input signals transmitted from a key board 72 which corresponds to the key board 12 in FIG. 2, thus processed results are displayed on a display device 73 (which corresponds to the display portion 14 in FIG. 2) and recording is then achieved with the aid of a recording apparatus 74 as constructed in the above-described manner via a driving circuit 71. Incidentally, reference numeral 75 designates a power supply source which is electrically connected to CPU 70 to supply electricity to components adapted to be operated electrically.

When a new printing paper 17 is loaded in the recording apparatus, the lock lever 26 is first pushed inwardly until it is disengaged from the hole **45*a* on the platen 45. At this moment the uppermost part 25 of the upper case 10 is caused to turn in the clockwise direction under the effect of resilient force of the spring 50. Since the pin 48 is slidably fitted into the elongated groove 49 on the platen 45, the latter is also turned in the clockwise direction in accordance with turning movement of the uppermost part 25 of the upper case 10. Thus, as shown in FIGS. 3 and 4, the pinch roller 40 mounted on the platen 45 is separated from the feed roller 46 and moreover the upper guide 55 is displaced away from the lower guide 52**.

While the thus opened state is maintained, the printing paper 17 can be easily placed on the area including the insert slit 19 and the lower guide 52 from above.

Figure 7:
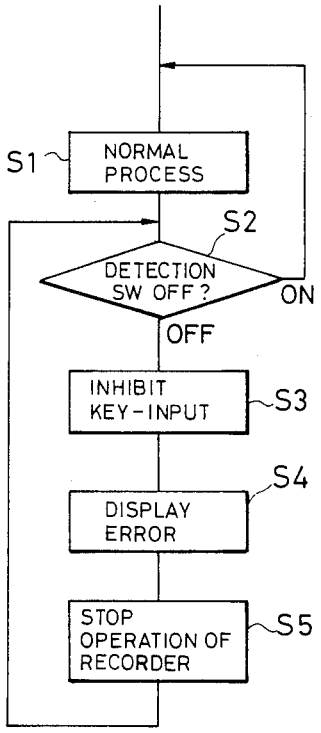
Figure 8:
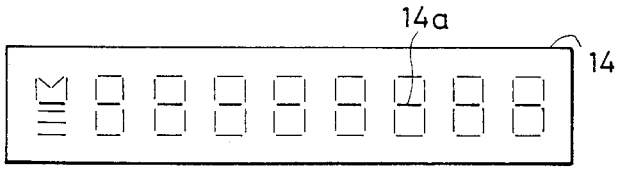

On the other hand, as shown in FIG. 4, the contact springs 61 and 62 in the switch 60 are kept opened whereby the switch 60 is ready to confirm that the platen 45 assumes the inoperative position. When it is confirmed that the platen 45 assumes the inoperative position, a plurality of operations are performed as represented by Steps 2 to 5 in FIG. 7. Specifically, when Step 1 in which the platen assumes the normal operative position is shifted to Step 2, it is detected that switch 60 is turned off. Then, when it is detected that the platen assumes the inoperative position, input from the key board 12 is inhibited by Step 3 and thereafter an occurrence of error is displayed in Step 4. In the illustrated embodiment error display is carried out by displaying as identified by reference numeral **14*a* on a certain figure as shown in FIG. 8. Next, operation of the recording apparatus 74 is stopped as represented by Step 5. Stoppage of operation continues until it is detected in Step 2 that the platen 45** is completely brought in the operative state.

Figure 5:
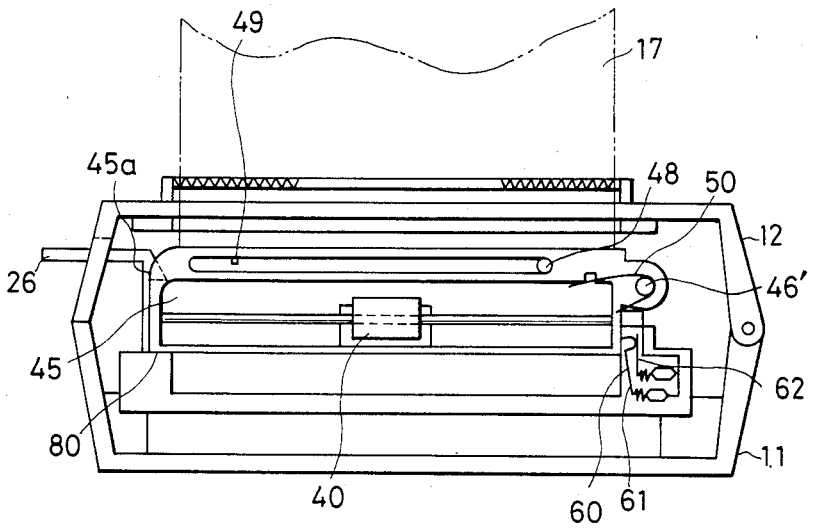

On completion of loading of the recording paper the uppermost part 25 of the upper case 10 is turned in the anticlockwise direction until the lock lever 26 is engaged to the hole **45*a* on the platen 45 as shown in FIG. 5. Thus, both the uppermost part 25 and the platen 45 are locked whereby the platen assumes the operative position. At this moment the switch 60 is closed by means of the side wall of the platen 45 and thereby the normal operative state is restored. As a result, Step 1 in FIG. 7** is resumed whereby normal operations can be performed.

In the above-described embodiment the switch for detecting that the platen assumes a predetermined operative position is constructed in the form of a mechanical switch but the present invention should not be limited only to this. Alternatively, an optical sensor including light beam emitting elements and light beam receiving elements, magnetic switch using magnetically responsive sensor, pressure switch using pressure sensor or the like may be employed in place of the mechanical switch. Furthermore, the position where the detecting switch is disposed should not be limited to the illustrated one. Alternatively, the detecting switch may be disposed at the position as identified by reference numeral 80 in FIG. 5 where the platen 45 comes in close contact with the base board when it is locked.

Moreover, recording medium conveying means constituted by a combination of retaining means and feeding means should not be limited to the illustrated structure. Alternatively, for instance, a combination of feeding means such as feed roller or the like and conventional means such as guiding means which are effective for conveying recording medium may be employed.

Incidentally, the recording medium employed for carrying out the present invention should not be limited only to recording paper but any recording medium such as plastic film or the like may be used when it is proven that recording can be effected therewith.

Figure 9:
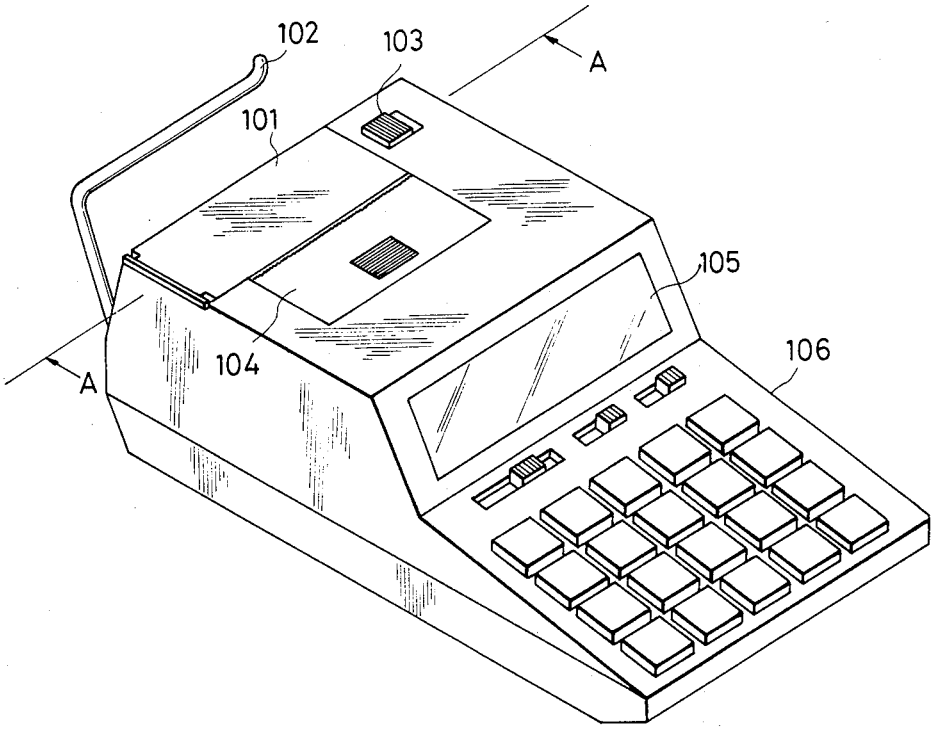
FIGS. 9 to 11 illustrate a desk-set type electronic calculator with a recording apparatus in accordance with the second embodiment incorporated therein.
Figure 10:
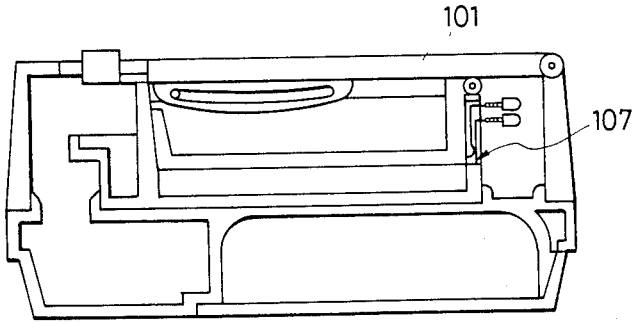
Figure 11:
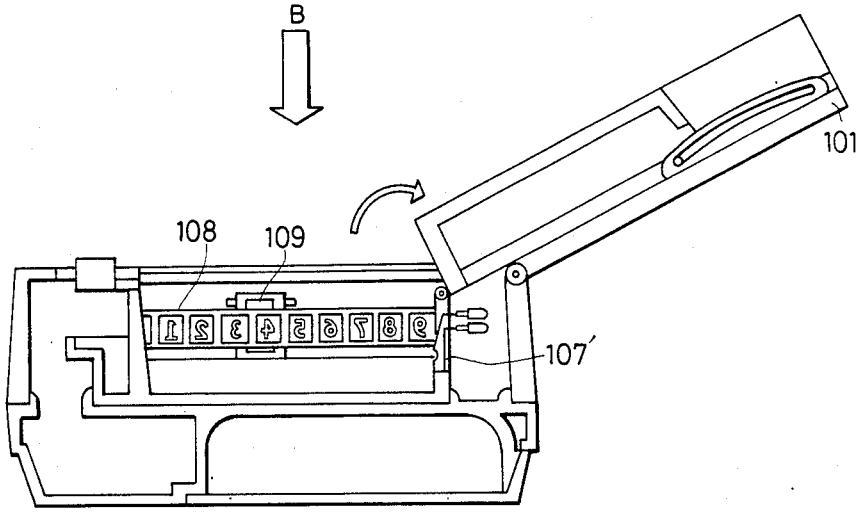

FIGS. 9 to 11 illustrate a calculator in accordance with the second embodiment of the present invention where a mechanism for turning the platen is constructed in a different manner from the first embodiment.

FIG. 9 is a perspective view of a calculator with a printer attached thereto. In the drawing, reference numeral 101 designates a turnable platen, reference numeral 102 is a printing paper holder and reference numeral 103 is an unlocking switch disposed on the upper surface of the cover case for releasing the platen 101 for the locked state. Further, reference numeral 104 designates a paper cutter, reference numeral 105 is a display device such as a fluorescent display lamp, liquid crystal or the like and reference numeral 106 is a key board. FIGS. 10 and 11 are a sectional view of the calculator taken in line A—A in FIG. 9 respectively, wherein FIG. 10 illustrates the operative state where the platen 101 is kept closed and FIG. 11 is the inoperative state where it is opened by a turning movement. In FIG. 10 reference numeral 107 designates a switch for detecting the operative state of the calculator. The switch 107 is turned on when it is pushed by means of the platen 101.

In FIG. 11 reference numeral 108 designates a printing ring for the printer and reference numeral 109 is a hammer. When the platen 101 is displaced from the operative state as shown in FIG. 10 to the inoperative state as shown in FIG. 11 by a turning movement thereof, the switch 107 which has been turned on assumes the inoperative state where it is turned off as represented by reference numeral 107'. While the inoperative state as mentioned above is maintained, loading of a recording paper is carried out from the above as represented by an arrow mark B in FIG. 11.

Next, FIGS. 12 to 16 illustrate a calculator in accordance with the third and fourth embodiments of the present invention which are different from the first and second embodiments in such a manner that a recording paper is not parted away from the lower guide when the platen is displaced away from the operative position by a turning movement or a lifting movement.

Figure 12:
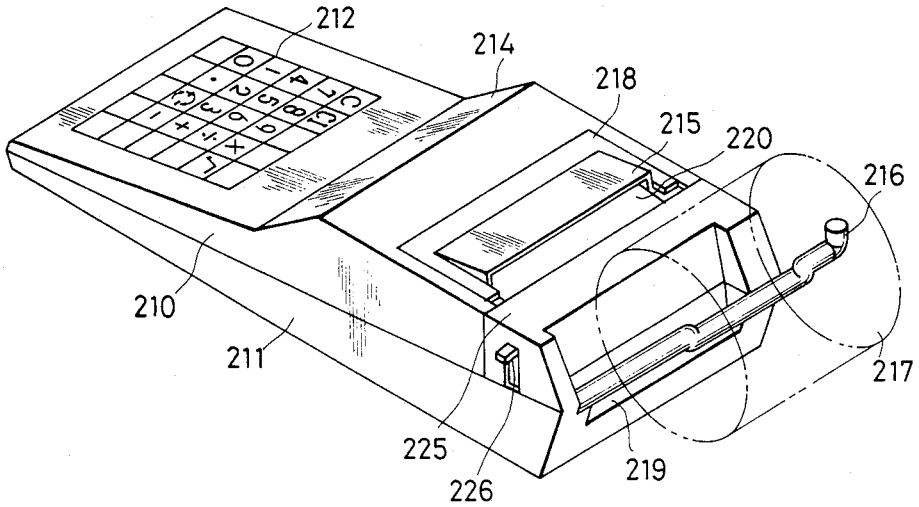
FIGS. 12 to 14 illustrate a desk-set type electronic calculator with a recording apparatus in accordance with the third embodiment incorporated therein.
Figure 13:
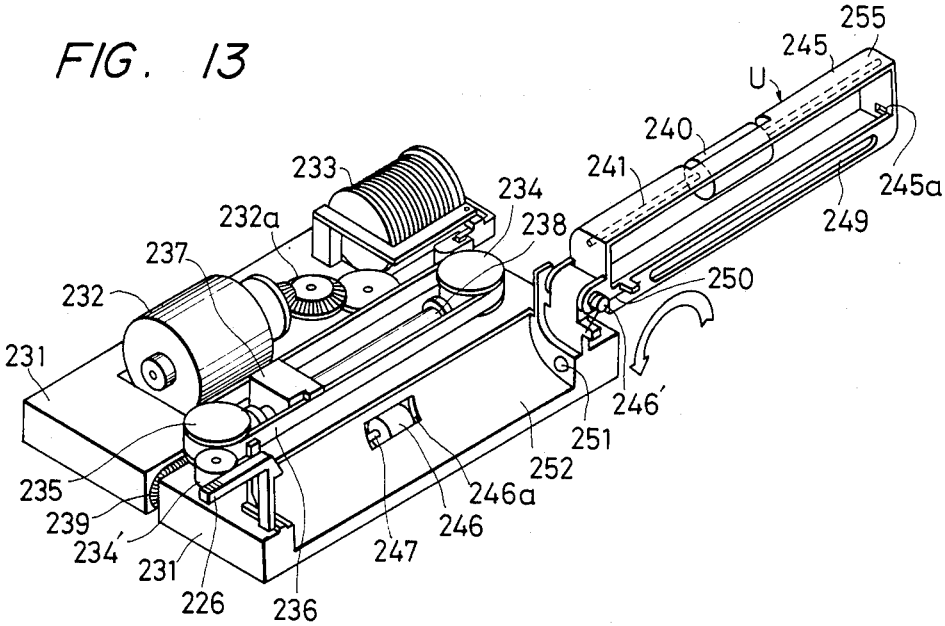
Figure 14:
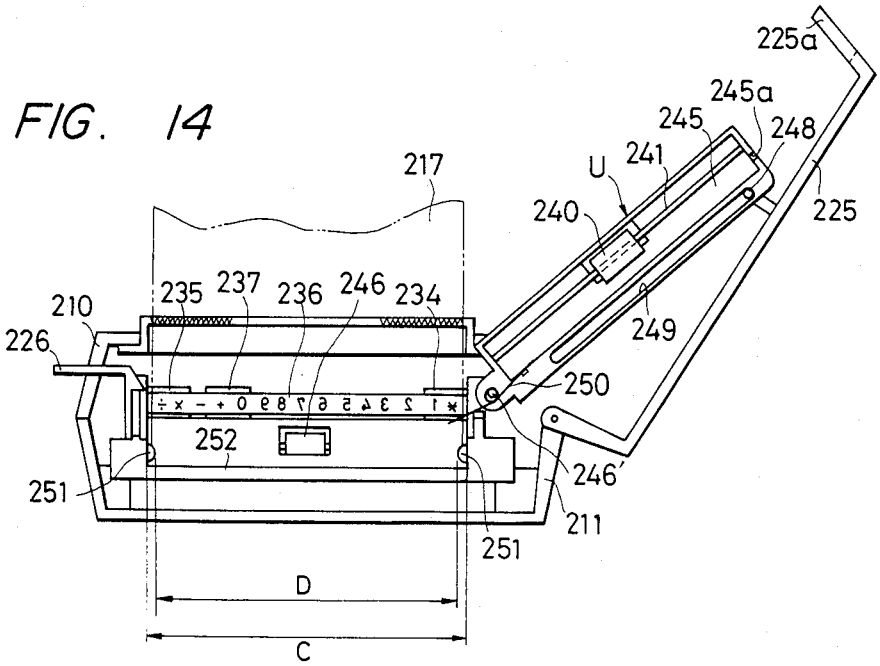

Specifically, FIGS. 12 to 14 illustrate a calculator in accordance with the third embodiment of the present invention in which the platen is displaced away from the operative position by a turning movement in the same manner as in the first and second embodiments.

FIG. 12 is a perspective view of the calculator having a recording apparatus in accordance with the third embodiment of the present invention incorporated therein. In the drawing, reference numeral 210 designates an upper case and reference numeral 211 is a lower case for the calculator. A number of functional components constituting the calculator are accommodated in the hollow space as defined by a combination of bcth the upper and lower cases 210 and 211. A key board is arranged on the fore side of the upper case 210 and data input is achieved by operating the key board 212. A number of data output from the key board 212 are processed with the aid of a central processing unit (not shown) and the results obtained by processing in that way are displayed on a display portion 214. Further, a paper cutter 215 made of transparent plastic material such as acrylic resin or the like is disposed on the upper end part of the upper case 210. Specifically, the paper cutter 215 is fixedly secured to a printer cover 218 which is detachably fitted to the upper case 210 whereby a roll-shaped recording paper 217 held on a recording paper holder 216 is cut to a certain length by means of the paper cutter 215. The printing paper 217 held on the holder 216 is manually unwound by an operator and its leading end is inserted into an insert slit 219. After recording is achieved on the printing paper 217 by means of the recording apparatus, it leaves an outlet slit 220 and it is then cut with the aid of the paper cutter 215.

The uppermost part 225 of the upper case 210 is turnably supported in such a manner as later described is opened or locked by actuating a lock lever 226.

FIGS. 13 and 14 are intended to clearly show the detailed inner structure of the recording apparatus while the uppermost part 225 is kept opened. In FIG. 13, reference numeral 231 designates a base board for the printer and various components are fixedly mounted on the base board 231. A motor 232 is an electrically driven motor of which rotation is transmitted to a driving pulley 234 via a train of gears **232*a*. A printing belt 236 is endlessly extended between the driving pulley 234 and a driven pulley 235. As shown in FIG. 14, a series of printing types in the form of numerals, symbols or the like are molded integral with the printing belt 236 over the whole outer surface of the latter. A carriage shaft 238 is bridged between the driving pulley 234 and the driven pulley 235 so that a carriage 237 reciprocably slides along the carriage shaft 236. Forward movement of the carriage 237 is achieved in accordance with movement of one of the printing types and backward movement of the same is achieved under the effect of a resilient force of a return coil spring 239**.

The carriage 237 has a hammer (not shown) incorporated therein and the hammer is actuated as a solenoid 233 is turned on.

Specifically, when the printing belt 236 is circulated with the aid of a combination of the driving pulley 234 and the driven pulley 235 as the motor 232 is rotated and thereby a required printing type to be subjected to printing assumes the position corresponding to the hammer incorporated in the carriage 237, the solenoid 233 is turned on, causing the printing belt 236 to stop its circulating movement temporarily. Subsequently, the hammer is actuated and thereby the printing type is forcibly thrust against the printing paper 217 under the effect of a hammering force generated by the hammer. As a result, printing is achieved on the printing paper 217 which is held between a platen 245 and the printing belt 236.

On completion of the first printing operation in that way, figure-up movement is carried out in such a manner that the carriage 237 is displaced by a distance of one figure in the direction toward upper figures (in the rightward direction as seen in FIG. 13) and at the same time the printing belt 236 is circulated by the same distance. After figure-up movement as mentioned above is repeated by the required number of figures, the carriage 237 is returned to its home position (the left end as seen in FIG. 13) under the effect of resilient force of the coil spring 236. 0n completion of returning movement of the carriage 237 paper feeding is initiated. Incidentally, reference numeral 234' designates an ink roller which is normally brought in contact with the printing belt 236 to supply the latter with ink.

Paper feeding is achieved by rotating paper feeding means, for instance, a feed roller 246 while the printing paper 217 is clamped between the paper retaining means, for instance, a pinch roller 240 and the aforesaid feed roller 246. The latter is rotatably supported on a shaft 247 which is extended on the base board 231 in the transverse direction, while the pinch roller 240 also is rotatably supported on a flexible pinch roller shaft 241 which is accommodated in the platen 245. In the illustrated embodiment a platen unit U is constituted by a combination of the pinch roller 240, the pinch roller shaft 241, the platen 245 and an upper guide 255 which is molded integral with the platen 245. Basically, the platen unit U is such that it includes at least a platen and in addition it includes one or more in combination among the upper guide 255, the pinch roller 240 and the pinch roller shaft 241.

The platen 245 is supported so as to turn about a shaft 246' which is fixedly mounted on the base board 231 at the position located in the vicinity of one end of the printing paper 217 as seen in the direction of width thereof. The shaft 246' has a twist spring 250 mounted thereon of which one end is engaged to a part of the platen 245 and of which other end is engaged to a part of the base board 231 whereby the platen 245 is normally urged to turn in the clockwise direction (as seen in FIG. 13). As shown in FIG. 14, the uppermost part 225 of the upper case 210 is provided with a pin 248 on the inner wall thereof and this pin 248 is slidably engaged to an elongated groove 245 which is formed on the platen 245. Further, the platen 245 is formed with an engagement hole **245*a* into which the foremost end of the lock lever 226 is inserted. Thus, when the uppermost part 225 of the upper case 210 is turned in the anticlockwise direction until the foremost end of the lock lever 226 is inserted into the hole 245*a*, both the uppermost part 225 and the platen 245 are brought into the locked state relative to the lower case 211**.

Further, the base board 231 is formed with two semispherical projections 251 on both inner side walls between which the platen 245 is accommodated in the operative state. The width D as measured between the tops of the semispherical projections 251 is determined to be less than the width C of a roll-shaped paper to be loaded on the apparatus, for instance, in the case where the roll paper has a width of about 57 mm, the width D is set to about 55 mm. On the other hand, the distance as measured between the center axis of the semispherical projection 251 and the lower guide 251 is determined sufficiently wide to temporarily hold the recording paper. Thus, when the platen 245 is kept in the locked state, the printing paper can be displaced in the space as defined between the upper guide 255 of the platen 245 and the lower guide 252.

When a new printing paper 217 is loaded on the recording apparatus, the lock lever 226 is first pushed inwardly until it is disengaged from the hole **245*a* on the platen 245. At this moment the uppermost part 225 of the upper case 210 is caused to turn in the clockwise direction under the effect of the resilient force of the spring 250. Since the pin 248 is slidably engaged to the elongated groove 249 on the platen 245, the latter also is turned in the clockwise direction in accordance with turning movement of the uppermost part 225 of the upper case 210. Thus, as shown in FIGS. 13 and 14, the pinch roller 240 mounted on the platen 245 is separated from the feed roller 246 and moreover the upper guide 255 is displaced away from the lower guide 252**.

While the thus opened state is maintained, the printing paper 217 can be easily placed on the area including the insert slit 219 and the lower guide 252 from above. Thus, the printing paper 217 is temporarily held in the space as defined between both the semispherical projection 251 and the lower guide 252. Even when the printing paper 217 is bent or flexed to some extent and thereby the effective width of the printing paper 217 is shortened, this reduction of the effective width can be compensated by both the projections 251 whereby the printing paper 217 can be stably held on the lower guide 252.

On completion of loading of the recording paper the uppermost part 225 of the upper case 210 is turned in the anticlockwiee direction until the lock lever 226 is engaged to the hole **254*a* on the platen 245. At this moment the upper guide 255 is located below the projection 251 and movement of the recording paper 217 is guided along both the upper guide 255 and the lower guide 252. Thus, the recording paper 217 is delivered to the position where the platen 245 assumes the operative position while it is clamped between the pinch roller 240 and the feed roller 246**.

Figure 15:
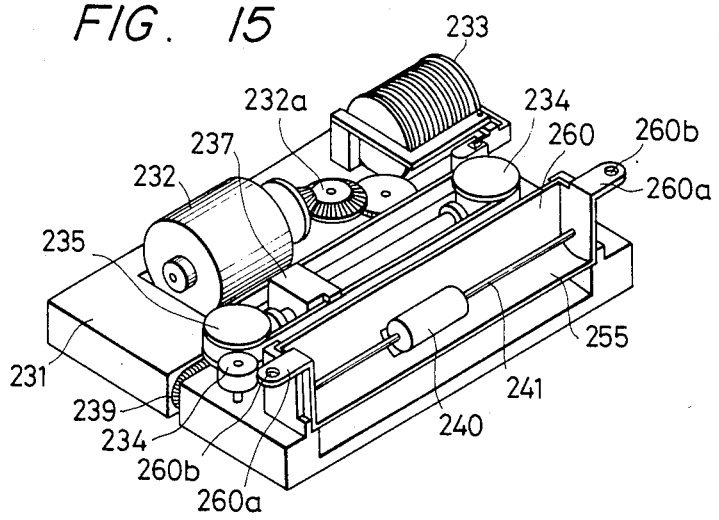
FIGS. 15 and 16 illustrate a recording apparatus in accordance with the fourth embodiment of the invention.
Figure 16:
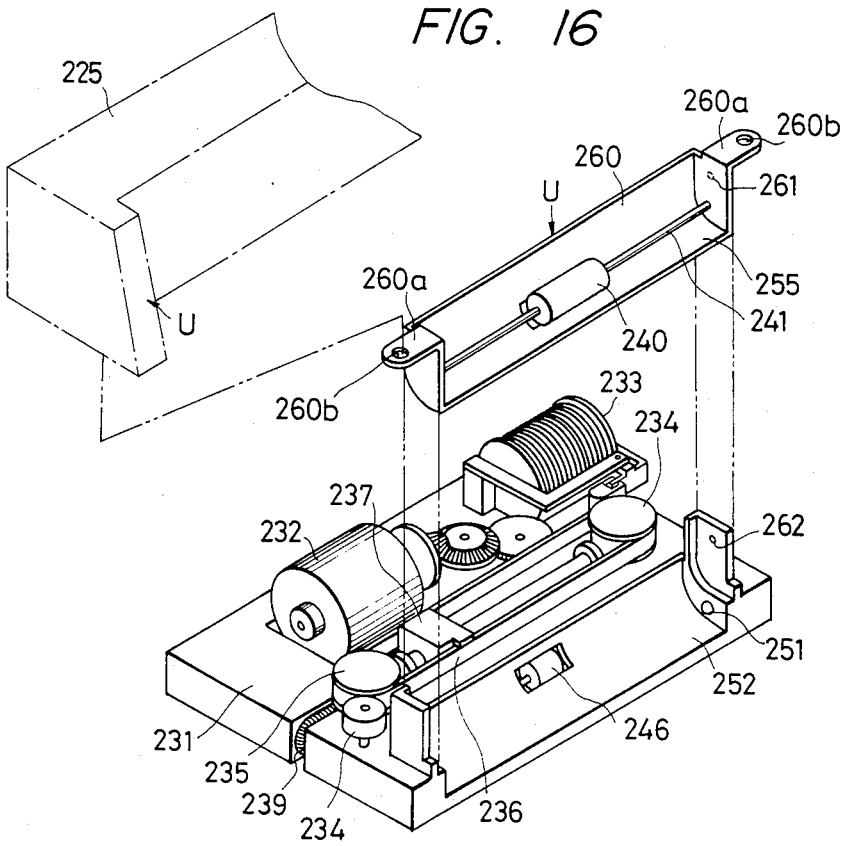

FIGS. 15 and 16 are a perspective view of a calculator in accordance with the fourth embodiment of the present invention respectively. Same components as those in FIG. 13 are identified by the same reference numerals and their repeated description will not be required.

In this embodiment, the platen 260 is not turned but it is displaced in the vertical direction while maintaining the horizontal posture in parallel with the working surface of the platen 260. Thus, the latter is detachably held on the base board 231 in the horizontal posture. Specifically, the platen 260 is provided with horizontally extending flanges **260*a* at both the ends thereof each of which has a through hole 260*b* formed thereon. The flanges 260*a* are fixedly secured to the uppermost part 225 of the upper case by means of set screws which are inserted through the holes 260*b*. Thus, as the uppermost part 225 of the upper case is displaced in the vertical direction, the platen 260 is raised up in the vertical direction together with the uppermost part 225 of the upper case. It should be noted that vertical displacement of the uppermost part 225 is carried out only after the lock lever 226 is unlocked. Further, the platen 260 is provided with semispherical projections 261 on both the outer side walls thereof, while the base board 231 is formed with complementary semispherical recesses 262 on both the inner side walls thereof. Owing to provision of the projections 261 and the recesses 262 made in that way, the platen 260 is immovably held by engagement of the projections 261 into the recesses 262**.

Since the apparatus is constructed in the above-described manner, loading of a new recording paper can be achieved simply, reliably and quickly by way of the steps of displacing the platen 260 in the vertical direction in accordance with vertical displacement of the uppermost part 225 of the upper case as shown in FIG. 16, placing the recording paper on the lower guide 252 and then setting the platen 260 in the operative state as shown in FIG. 15.

In the third and fourth embodiments as described above the semispherical projections 251 are intended to temporarily (provisionally) hold the recording paper after the platen is raised up away from the lower guide or it is turned away from the same. Accordingly, the geometrical configuration of the projections 251 should not be limited only to those illustrated. Further, a plurality of projections of the above-mentioned above may be provided to assure more reliable holding of the recording paper. Moreover, the projections may be so designed that they are retracted inwardly or sprung outwardly after the platen 250 is turned away from the operative position. As another modification the projections 251 may be made of material over which any article can easily slide. Alternatively, the surface of each of the projections 251 may be coated with elastomeric material such as rubber or the like.

Next, FIGS. 17 to 23 illustrate a calculator in accordance with the fifth and sixth embodiments of the present invention which are characterized in that when the platen is displaced away from the operative position, the recording paper is inhibited from coming in contact with a recording section including the printing member and to this end a contamination inhibitive member is provided in such a manner as to move in operative association with movement of the platen toward the operative position and away from the latter.

Figure 17:
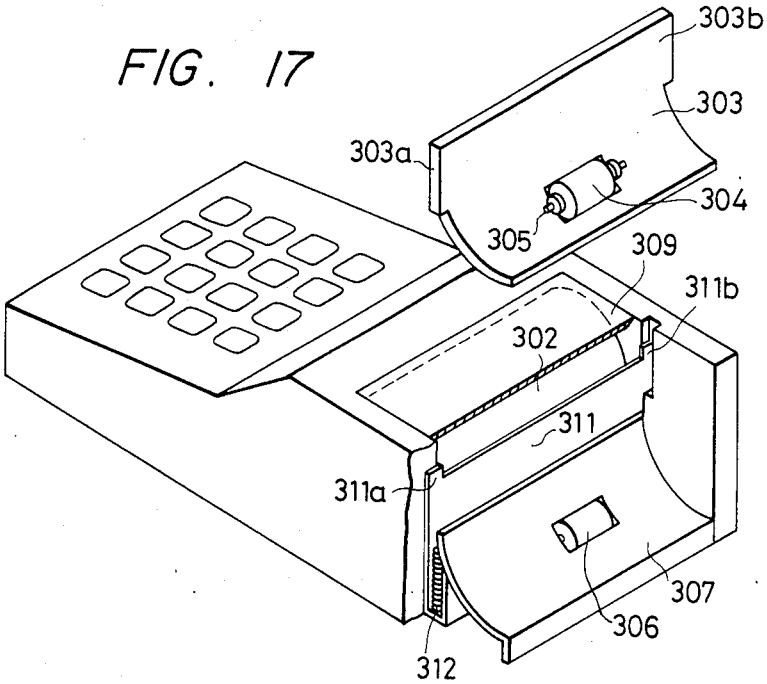
FIGS. 17 to 19 illustrate a desk-set type electronic calculator with a recording apparatus in accordance with the fifth embodiment incorporated therein.
Figure 18:
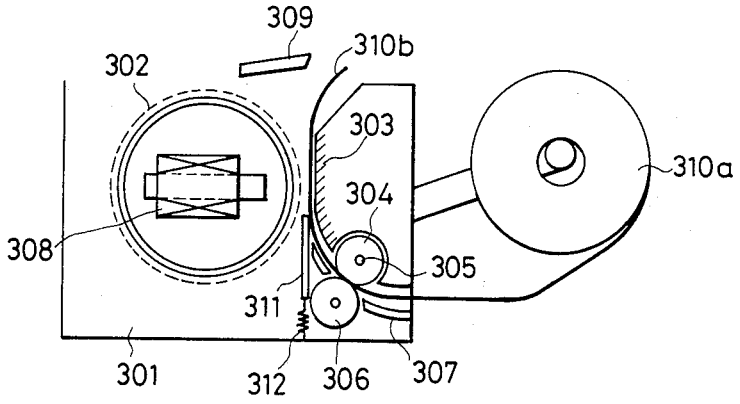
Figure 19:
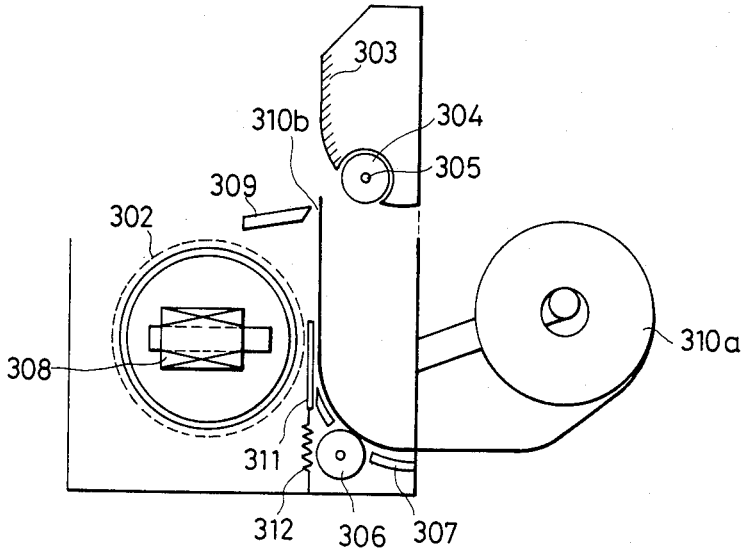

Specifically, FIGS. 17 to 19 illustrate a calculator in accordance with the fifth embodiments of the present invention, wherein FIG. 17 is a perspective view of the calculator with a printer incorporated therein.

As shown in FIG. 17, the platen 303 is assembled integral with a pinch roller 304 and a pinch roller shaft 305 on which the pinch roller is rotatably mounted. The platen 304 can be removed from the case in the vertical direction. The apparatus is provided with a movable contamination inhibitive plate 311 to which a plurality of coil springs 312 are attached.

Setting of a new recording paper is carried out by way of the following steps. First, the platen 303 is removed from the operative position and a roll-shaped recording paper 310*a* is then mounted on a holder. The fore end part 310*b* unwound from the roll-shaped paper 310*a* is placed on a feed roller 306, a contamination inhibitive plate 311 and a paper cutter 309 (see FIG. 19). At this moment the contamination inhibitive plate 311 is displaced upwardly under the effect of a resilient force of the springs 312 until it is interposed between the drum 302 serving as printing member and the fore end part 310*b* of the recording paper to inhibit an occurrence of contamination. In the drawings reference numeral 308 designates a hammer.

Next, the platen 303 is fitted to the operative position. At this moment projections 303*a* and 303*b* on the platen 303 abut against projections 311*a* and 311*b* on the movable contamination inhibitive plate 311 whereby the latter is displaced downwardly against the resilient force of the springs 312 (see FIG. 18). The case is provided with pawls or projections or a cover (not shown) in order to removably hold the platen 303. When the platen 303 is removed from the case, the pawls or the projection or the cover as mentioned above are released from the locked state and thereby the platen 303 and the contamination inhibitive plate 311 are sprung upwardly under the effect of the resilient force of the coil springs 312. Thus, the contamination inhibitive plate 311 is sprung upwardly at the same time the platen 303 is released from the locked state. Similarly, the former is displaced downwardly at the same time when the latter is restored to the operative position.

Since such an arrangement is made that the contamination inhibitive plate 311 is sprung upwardly at the same time when the platen 303 is displaced away from the operative position, there is no fear of causing contamination of the printing paper, an operator's hand or the like with ink or the like.

FIGS. 20 to 23 illustrate a calculator in accordance with the sixth embodiment of the present invention.

Figure 20:
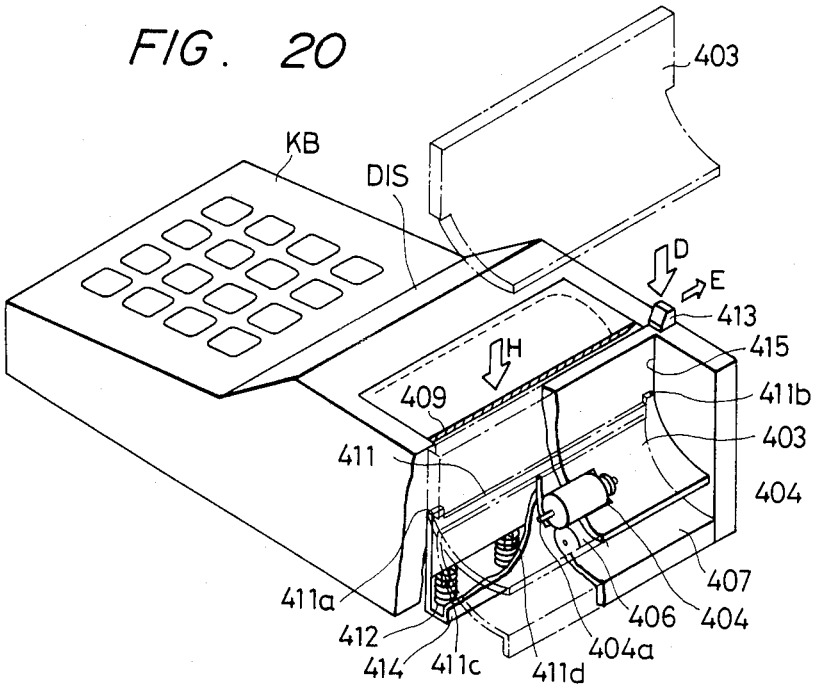
FIGS. 20 to 23 illustrate a desk-set type electronic calculator with a recording apparatus in accordance with the sixth embodiment incorporated therein.
Figure 21:
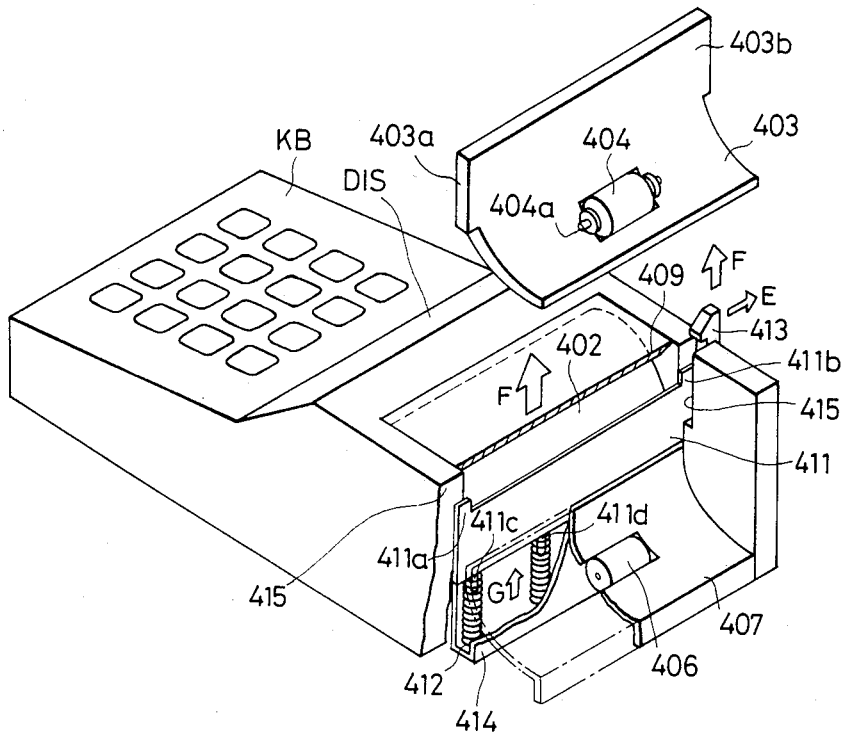

FIGS. 20 and 21 are a perspective view of a calculator particularly illustrating the detailed structure of the calculator having a printing apparatus incorporated therein which is detachably equipped with a platen. FIG. 20 illustrates the operative state of the calculator in which the platen assumes the operative position and FIG. 21 shows the inoperative state of the same in which the platen is displaced away from the operative position. Printing paper and a holder are not shown in the drawings for the purpose of simplification of illustration.

A key board KB from which a variety of data in the form of numerals, processing commands or the like are outputted is arranged in the fore area of the calculator which is stepped down from the printing section and a display portion DIS including a display (not shown) for displaying numerical input values and results of processing is disposed on the inclined area between the key board KB and the printing section. A printing apparatus for outputting numerical input values and results of processing is disposed at the rear area of the calculator.

Figure 22:
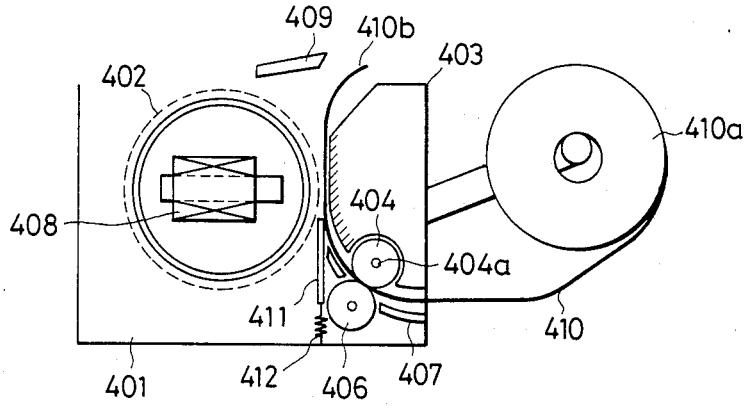
Figure 23:
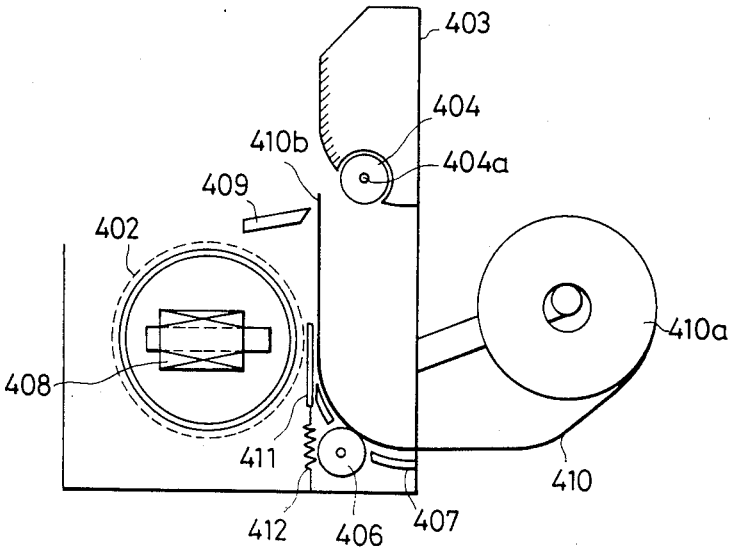

Structure of the printing apparatus is schematically illustrated in FIGS. 22 and 23. A platen 403 is assembled integral with a pinch roller 404 in such a manner that it can be removed from the case of the calculator in the same manner as in the foregoing embodiment but structure of a paper guide 407 and a contamination inhibitive plate 411 is different from that in the foregoing embodiment.

Specifically, the contamination inhibitive plate 411 of substantially rectangular shape is disposed independently of a paper guide 407. It is disposed movably in the vertical direction as seen in FIGS. 20 to 23, that is, in the same direction as that of feeding of a printing paper 410 at the position located in the proximity of the foremost end of the paper guide 407. The contamination inhibitive plate 411 is vertically displaceably disposed in the hollow space as defined by a combination of the holding member 414 having the substantially U-shaped cross-sectional configuration as seen in FIGS. 20 and 21 and the groove 415 formed adjacent the rear wall of the calculator. A plurality of coil springs 412 accommodated in the holding member 414 are resiliently mounted on a plurality of pins 411*c* and 411*d* which stand upright from the lower end of the contamination inhibitive plate 411. Thus, the contamination inhibitive plate 411 is normally urged in the direction as identified by an arrow mark G in FIG. 21 under the effect of a resilient force of the coil springs 412. The contamination inhibitive plate 411 is formed with projections 411*a* and 411*b* on both sides of the upper end thereof which are adapted to abut against the lower ends of projections 403*a* and 403*b* formed on both the sides of the platen 403 whereby upward and downward movement of the contamination inhibitive plate 411 is limited by abutment of the projections 411*a* and 411*b* against the projections 403*a* and 403*b*.

Incidentally, both the projections 403*a* and 403*b* on the platen 403 are slidably fitted into the groove 415 and the platen 403 is firmly held in the inserted state by engaging the pawl on the resilient member 413 to the uppermost end of the platen 403. As is apparent from the drawing, the resilient member 413 having the pawl formed at the uppermost end is normally disposed outwardly of the groove 415.

When the platen 403 is set to the operative position, it is displaced downwardly toward the paper guide 407 from above in the direction as identified by an arrow mark H in FIG. 20. During setting operation of the platen 403 the inclined faces of the pawls on the resilient members 413 are first depressed by the lower ends of the projections 403*a* and 403*b* of the platen 403 and the resilient members 413 are then flexed outwardly in the direction as identified by an arrow mark E whereby the projections 403*a* and 403*b* of the platen 403 are inserted into the groove 415. When the platen 403 is displaced downwardly to the position where the upper ends of the projections 403*a* and 403*b* are located below the pawls, each of the resilient members 413 is restored to the original position as shown in FIG. 20 until the pawls are engaged to the upper ends of the projections 403*a* and 403*b*. As a result, the contamination inhibitive plate 411 is stably held in the groove 415. As the projections 403*a* and 403*b* on the platen 403 are brought in abutment against the projections 411*a* and 411*b* on the contamination inhibitive plate 411 in accordance with downward movement of the platen 403, the contamination inhibitive plate 411 is displaced downwardly against the resilient force of the coil springs 412. When the platen 403 assumes the operative position in the above-described manner, the upper end of the contamination inhibitive plate 411 is located at the position lower than the printing hammer 408 where no printing operation is hindered, as shown in FIG. 22.

When the platen 403 is removed from the apparatus, both the resilient members 413 are flexed outwardly in the direction as identified by an arrow mark E in FIG. 21 until the pawls are disengaged from the platen 403 whereby the contamination inhibitive plate 411 is displaced upwardly in the direction as identified by an arrow mark G in the drawing under the action of the resilient force of the coil springs 412, causing the platen 403 to be sprung up. Now, the platen 403 is ready to be easily removed upwardly in the direction as identified by an arrow mark F in the drawing.

On completion of removal of the platen 403 in that way, the upper end of the contamination inhibitive plate 411 is located at the position higher than the printing hammer 402 in front of the printing ring 402 to cover an area more than the lower half of the printing ring 402, as shown in FIG. 23.

Accordingly, when the platen 403 is displaced away from the operative position, a space required for inhibiting the printing paper 410 from coming in contact with the printing ring 402 with the contamination inhibitive plate 411 interposed therebetween increases, resulting in contamination caused by contact of the printing paper 410 and an operator's hand with the printing ring 402 being prevented effectively.

It should of course be understood that the movable contamination inhibitive plate as constructed in the above-described manner may be employed for other types of recording apparatus.

Figure 24:
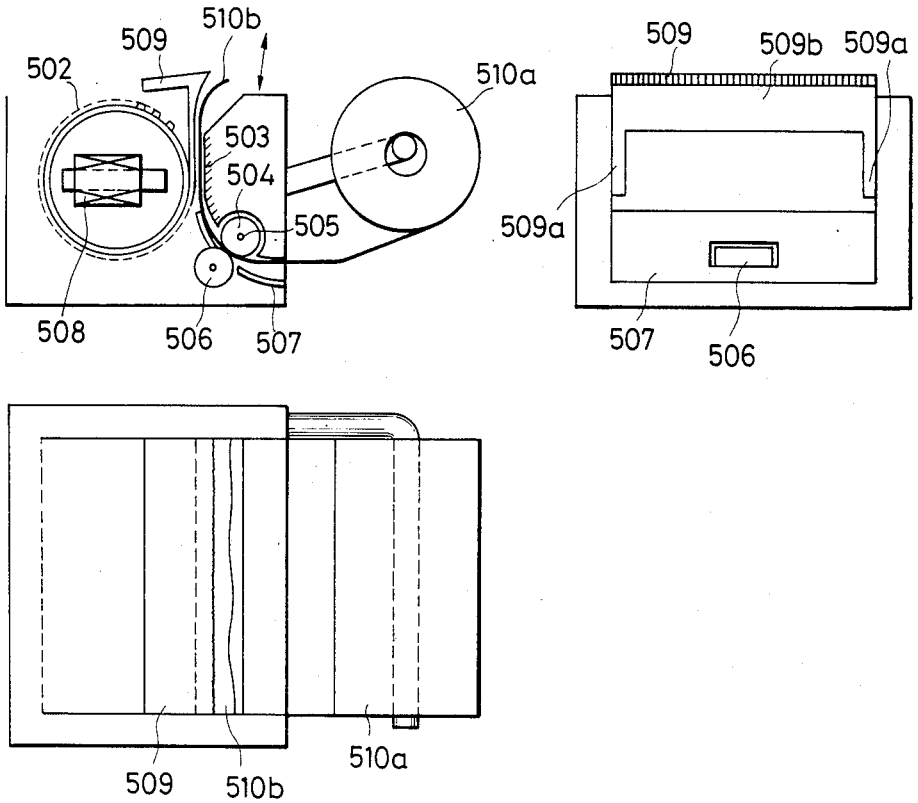
FIG. 24 illustrates a recording apparatus in accordance with the seventh embodiment of the invention.

Finally, FIG. 24 illustrates a calculator in accordance with the seventh embodiment of the present invention which is characterized in that when the platen is removed from the apparatus, the printing paper is inhibited from coming in contact with the printing section by means of a paper cutter which serves as contamination inhibitive means and the whole structure is simplified remarkably.

As shown in the drawing, the paper cutter 509 is integrally provided with contamination inhibitive members 509*a* and a winding inhibitive portion 509*b* at the lower end part thereof. The contamination inhibitive members 509*a* are designed in the form of a projection which extends downwardly from each of both ends of the paper cutter 509 as seen in the direction of width of printing paper.

The winding inhibitive portion 509*b* is bridged between both the contamination inhibitive members 509*a* at the bottom end part of the paper cutter 509 whereby both contamination inhibitive members 509*a* are connected to one another via the winding inhibitive portion 509*b*. The contamination inhibitive members 509*a* and the winding inhibitive portion 509*b* are interposed between the printing paper 410 and the printing drum 502 having a number of printing types arranged thereon. In the drawing, reference numeral 507 designates a lower guide, reference numeral 506 is a feed roller, reference numeral 508 is a hammer, reference numeral 510*a* is a roll-shaped recording paper and reference numeral 510*b* is a part of the recording paper which is unwound from the paper holder.

The lowermost end of each of the contamination preventive members 509*a* is located higher than the printing area where printing is effected by means of a printing type on the printing drum 502 so that the recording paper does not come in contact with the group of printing types when both the end parts of the recording paper 510 come in contact with the contamination inhibitive members 509*a*.

The winding inhibitive portion 509*a* serves to inhibit an occurrence of winding of the recording paper 510 and moreover it functions for the recording paper 510 also as contamination inhibitive means.

While the present invention has been described above with respect to several preferred embodiments thereof, it should of course be understood that it should not be limited only to them but various changes or modifications may be made in any acceptable manner without departure from the spirit and scope of the invention as defined by the appended claims.

We claim:

1. A recording apparatus including a main section having an outer case in which a recording section is accommodated and a holder disposed outwardly of said outer case to hold a roll-shaped recording sheet thereon, comprising:

guide means having a first guide surface along which a part of the recording sheet unwound from the sheet roll held on said holder is delivered to a recording position on the recording section where recording is effected;

a sheet feeding member disposed on said first guide surface of said guide means;

platen means with a length extending in an axial direction and having a second guide surface adapted to be located opposite to said first guide surface, a pressing member adapted to come in forcible contact with said sheet feeding member and a platen surface which is exposed to the recording position on the recording section; and holding means for rotatably holding said platen means in an operative position where said second guide surface is located opposite to the first guide surface and the platen surface is exposed to the recording position on the recording section, wherein said holding means is supported on the main section in such a manner that an end portion of said elongated platen means is rotated about an axis substantially perpendicular to the axial direction of said platen.

2. A recording aparatus according to claim 1, further comprising spring means biasing said platen means away from the operative position, and wherein said holding means includes a pawl member for removably holding the platen means at the operative position against a resilient force of said spring means.

3. A recording apparatus according to claim 1, wherein the outer case further comprises cover means, said cover means being openably disposed to cover an upper surface of said platen means, wherein said cover means is operatively connected to said platen means in such a manner that said platen means is displaced away from the operative position in response to an opening operation of said cover means and it is restored to the original operative position in response to a closing operation of the cover means.

4. A recording apparatus according to claim 1, wherein said pressing member is a pinch roller.

5. A recording apparatus according to claim 3, wherein said cover means is rotatably supported about a turning axis which is parallel with the axis of rotation of said platen means, and said cover means includes a pin member which is in sliding engagement with a groove in said platen means such that said cover means and said platen means are cooperatively rotated.

* * * * *

UNITED STATES PATENT AND TRADEMARK OFFICE

CERTIFICATE OF CORRECTION

PATENT NO. : 4,772,146

DATED : September 20, 1988

INVENTOR(S) : YASUHIDE SAITO, ET AL.

It is certified that error appears in the above-identified patent and that said Letters Patent is hereby corrected as shown below:

AT [56] REFERENCES CITED

Foreign Patent Documents, "31361192" should read --3136192--.
Foregin Patent Documents, "59-483" should read --59483--.

AT [57] ABSTRACT

Line 25, "resilient of" should read --resilient--.

COLUMN 1

Line 50, "is" should read --and is--.

COLUMN 2

Line 26, "turning" should read --a turning--.

COLUMN 6

Line 12, "does" should read --designates--.
Line 54, "shaft 36." should read --shaft 38.--.

COLUMN 7

Line 2, "thrusted" should read --thrust--.

UNITED STATES PATENT AND TRADEMARK OFFICE

CERTIFICATE OF CORRECTION

PATENT NO. : 4,772,146

DATED : September 20, 1988

INVENTOR(S) : YASUHIDE SAITO, ET AL.

It is certified that error appears in the above-identified patent and that said Letters Patent is hereby corrected as shown below:

COLUMN 9

Line 42, "for" should read --from--.

COLUMN 10

Line 2, "parted away" should read --separated--.
Line 18, "bcth" should read --both--.
Line 40, "is" should read --and is--.
Line 57, "carriage shaft 236." should read --carriage shaft 238.--.

COLUMN 11

Line 55, "elongated groove 245" should read --elongated groove 249--.

COLUMN 12

Line 6, "lower guide 251" should read --lower guide 252--
Line 40, "anticlockwiee" should read --anticlockwise--.

COLUMN 13

Line 27, "above" should read --type--.
Line 48, "embodiments" should read --embodiment--.
Line 54, "platen 304" should read --platen 303--.

UNITED STATES PATENT AND TRADEMARK OFFICE

CERTIFICATE OF CORRECTION

PATENT NO. : 4,772,146

DATED : September 20, 1988

INVENTOR(S) : YASUHIDE SAITO, ET AL.

It is certified that error appears in the above-identified patent and that said Letters Patent is hereby corrected as shown below:

COLUMN 16

Line 2, "hammer 402" should read --hammer 408--.

COLUMN 18

Line 18, "aparatus" should read --apparatus--.

Signed and Sealed this

Nineteenth Day of September, 1989

*Attest:*

DONALD J. QUIGG

*Attesting Officer*

*Commissioner of Patents and Trademarks*